US006298512B1

(12) United States Patent
Hagen

(10) Patent No.: US 6,298,512 B1
(45) **Date of Patent: *Oct. 9, 2001**

(54) MULTI PURPOSE HINGE PIN AND PLASTIC CLIP REMOVER

(76) Inventor: Glenn A. Hagen, P.O. Box 8651, Keystone, CO (US) 80435

( * ) Notice: Subject to any disclaimer, the term of this patent is extended or adjusted under 35 U.S.C. 154(b) by 0 days.

This patent is subject to a terminal disclaimer.

(21) Appl. No.: 09/558,808

(22) Filed: Apr. 26, 2000

(51) Int. Cl.[7] ..... B66F 15/00
(52) U.S. Cl. ..... 7/166; 81/20; 7/144
(58) Field of Search ..... 7/143, 144, 146, 7/147, 166; 81/20, 25, 26, 45; 29/267; 254/25

(56) References Cited

U.S. PATENT DOCUMENTS

| | | | | |
|---|---|---|---|---|
| 305,670 | * | 9/1884 | Christie | 254/21 |
| 886,987 | * | 5/1908 | Kiehle | 7/144 |
| 974,021 | * | 10/1910 | Blake | 81/25 |
| 1,121,085 | * | 12/1914 | Fitzgerald | 81/25 |
| 1,130,147 | * | 3/1915 | Coles | 254/25 |
| 1,454,239 | * | 5/1923 | Kawamura | 254/25 |
| 1,903,557 | * | 4/1933 | Swoyer | 254/25 |
| 2,061,754 | * | 11/1936 | Casey | 254/25 |
| 2,186,333 | * | 1/1940 | Giersch | 254/25 |
| 2,457,231 | | 12/1948 | Henderson . | |
| 2,763,172 | * | 9/1956 | Richards | 72/482.94 |
| 2,938,412 | * | 5/1960 | Walker | 72/479 |
| 2,966,334 | * | 12/1960 | Thurman | 254/26 R |
| 3,680,834 | | 8/1972 | Holloway . | |
| 3,769,644 | | 11/1973 | Case . | |
| 3,813,081 | | 5/1974 | Alger . | |
| 4,042,210 | | 8/1977 | Feldmann . | |
| 4,182,390 | | 1/1980 | Renner . | |
| 4,183,385 | * | 1/1980 | Burkybile | 81/29 |
| 4,188,701 | | 2/1980 | Ludwig . | |
| 4,464,819 | | 8/1984 | Steck et al. . | |
| 4,844,416 | | 7/1989 | Crowbar . | |
| 5,054,180 | | 10/1991 | Combs . | |
| 5,184,385 | | 2/1993 | Valesh . | |
| 5,207,126 | | 5/1993 | Schaben . | |
| 5,255,575 | * | 10/1993 | Williams | 81/25 |
| 5,322,264 | | 6/1994 | Giambro . | |
| 5,438,743 | | 8/1995 | Simington et al. . | |
| 5,495,651 | | 3/1996 | Tsuha . | |
| 5,896,607 | | 4/1999 | Hagen . | |

* cited by examiner

*Primary Examiner*—Joseph J. Hail, III
*Assistant Examiner*—David B. Thomas
(74) *Attorney, Agent, or Firm*—Rick Martin; Patent Law Offices of Rick Martin P.C.

(57) ABSTRACT

A multi purpose hinge pin and plastic clip remover can also be used as a hammer and a pry bar. The preferred embodiment has a bar shape with the claw having a V shaped pry bar with a top surface designed to fit under a plastic cap. The V has a width designed to clasp the shank of the plastic cap. The V pry bar also has a pry ridge mid way down the V to grasp the ribs or threads of the plastic clip. A second embodiment has a hand guard and hammerhead. The hammerhead has a threaded hole to receive a plurality of tools.

21 Claims, 4 Drawing Sheets

MULTI PURPOSE HINGE PIN AND PLASTIC CLIP REMOVER

FIELD OF THE INVENTION

The present invention relates to a hinge bolt remover especially suited to remove car door hinge bolts as well as pop rivets.

BACKGROUND OF THE INVENTION

The closest known prior art is U.S. Pat. No. 5,896,607 (1999) to the same inventor as the present invention, Glen Hagen. The –607 invention discloses a hinge pin remover with a hand guard and other work tools integrated into the tool including a hammer.

Two separate improvements have been added to the '607 invention. The first and preferred embodiment is the addition of a pry ridge to the V pry bar. The pry ridge fits under one of the plastic ribs of a plastic clip (pop rivet) commonly used in car interiors. The top surface of the V pry bar fits under the top of the plastic clip. To pry off the plastic clip the tool is leveraged to lift up on the top of the plastic clip and one of its ribs simultaneously, thereby spreading the prying force across both the top of the plastic clip and one of its ribs. The benefits are the prevention of snapping off the top of the plastic clip. If the top is snapped off time is lost in drilling and/or plier type removal work.

Another improvement is the addition of a threaded hole on the '607 invention to receive a plurality of work tools including an extended head hammer, a pick(s), and a chisel/ax tool.

SUMMARY OF THE INVENTION

The primary aspect of the present invention is to provide a pry ridge in a V shaped working end of a pry bar in order to grasp a rib or thread of a plastic clip as well as its top to remove it without breaking its top.

Another aspect of the present invention is to choose the proper angle of the V in order to simultaneously fit under a thread and a top of the plastic clip.

Another aspect of the present invention is to provide a threaded hole in a multi purpose hinge pin remover to receive a plurality of working tools.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
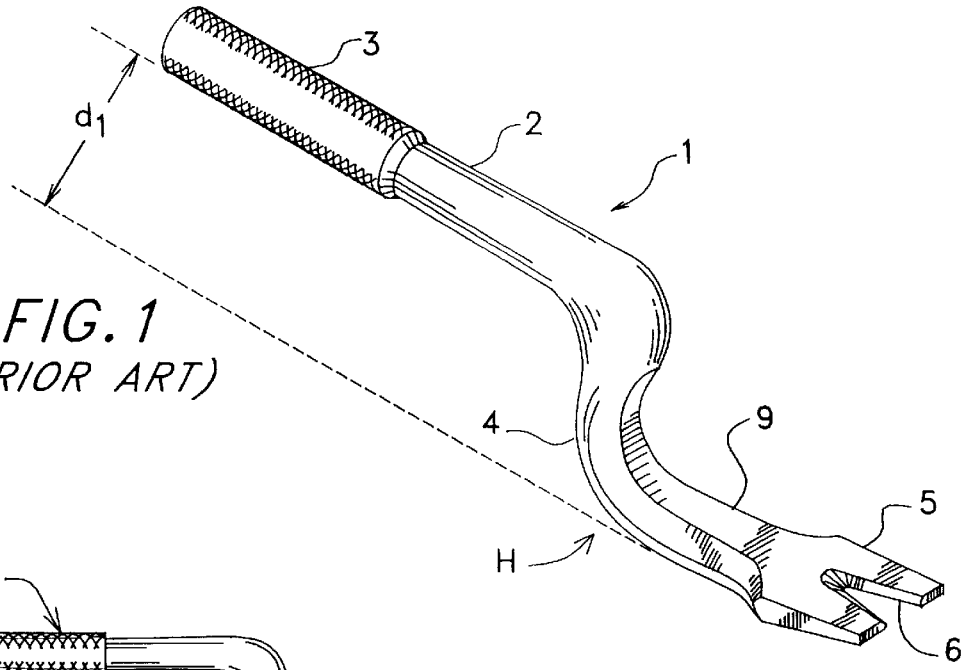
FIG. 1 (PRIOR ART)
FIG. 1 (prior art) is a top perspective view of a first embodiment of a hinge pin remover.

Referring first to FIG. 1 a hinge pin remover 1 has a central shank 2, a distal handle 3 and a proximal working notch 6. The proximal working notch 6 is cut into a pry bar end 9 having a transition shaft 4 connecting it to the central shank 2. An offset of $d_1$ exists between central shank 2 and pry bar end 9 which are parallel. The handle 3 is knurled.

Figure 2:
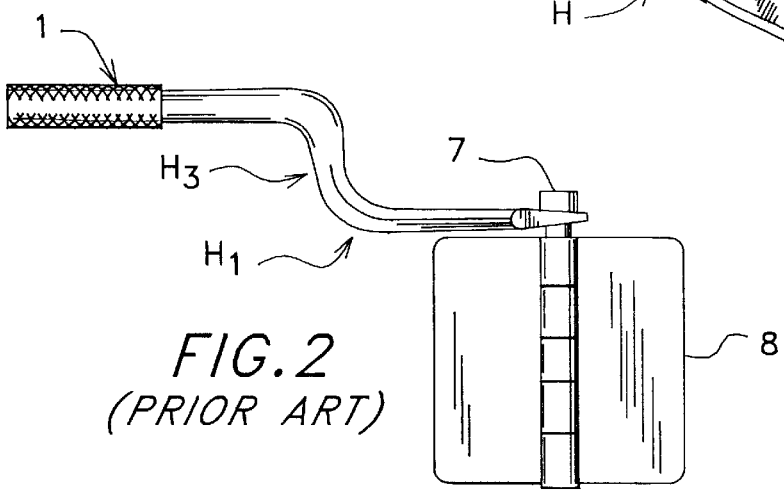
FIG. 2 (PRIOR ART)
FIG. 2 (prior art) is a top perspective view of the tool of FIG. 1 removing a hinge pin.

A hammer tap at $H_3$ may be needed to engage the hinge pinhead as shown in FIG. 2. Once the working notch 6 is engaged a hammer blow at $H_1$ lifts the hinge pin 7 from the hinge 8. The working notch 6 is also useful to pop out roof liner pop rivets, door liner pop rivets and the like.

Figure 3:
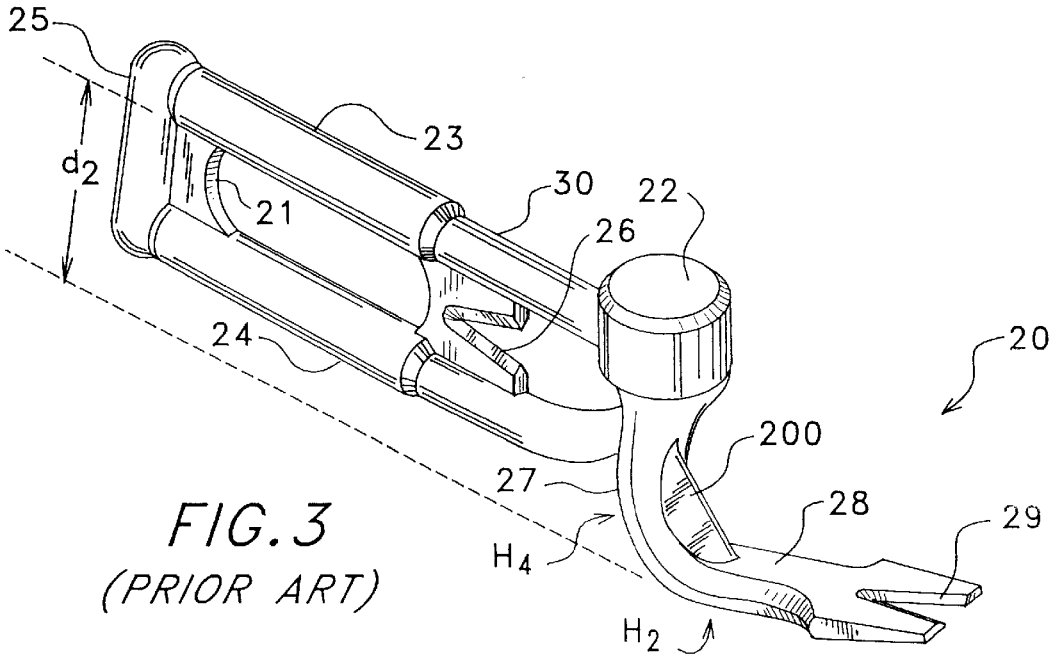
FIG. 3 (PRIOR ART)
FIG. 3 (prior art) is a top perspective view of a second and preferred embodiment of a hinge pin remover.

Referring next to FIG. 3 a hinge pin remover 20 has a central shank 30, a distal handle 23, and a proximal working notch 29. The proximal working notch 29 is cut into a pry bar end 28 having a transition shaft 27 connecting it to the central shank 30. An offset of $d_2$ exists between central shank 30 and pry bar end 28 which are parallel. The handle 23 is knurled.

The hammer tap at $H_4$ may be needed to engage the hinge pinhead. Once the working notch 29 is engaged a hammer blow at $H_2$ lifts the hinge pin from the hinge in a like fashion as shown in FIG. 2. The hand guard 24 protects the worker's hand during use. The offset $d_2$ enables the hand guard 24 to not interface with the work in close quarters. Nominally $d_1=d_2$=two inches.

Further uses of the hinge pin remover 20 include using the hammer 22. Hitting the brace 25 can drive the working notch 29 or the working pry ridge 21 or the working notch 26. A roofer can use all the above noted working surfaces to remove shingles and nails and drive in nails into new shingles. Cutting edge 200 can be used as a tarpaper splitter by thrusting it across the tarpaper.

Figure 7:
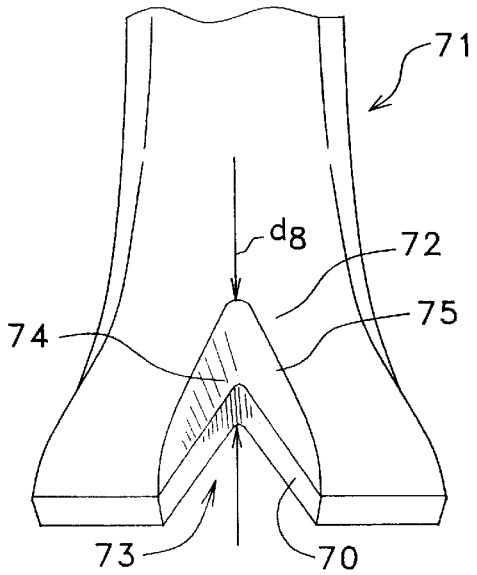
FIG. 7 is a front plan view of the preferred embodiment showing the pry ridge.

The working notches 6,29 could have an equivalent pry ridge 70 shown in FIG. 7 included in them.

Plastic clips known as pop rivets are used in car interiors to fasten roof door liners. Auto body shops must remove and refasten them in the least time to make a profit. Although the tools shown in FIGS. 1–3 could be used to remove pop rivets as well as to remove hinge bolts, they tend to break off the tops of the pop rivets. The reason for this is that all the prying force is applied to the fragile plastic top.

Figure 4:
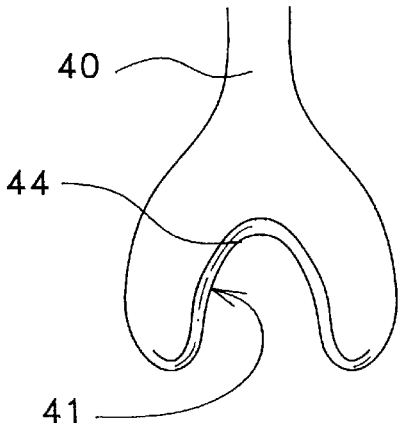
FIG. 4 (PRIOR ART)
FIG. 4 (prior art) is a top plan view of a known U shaped working end of a plastic clip remover.
Figure 5:
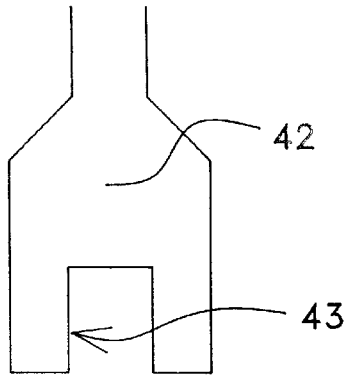
FIG. 5 (PRIOR ART)
FIG. 5 (prior art) is a top plan view of a known square shaped working end of a plastic clip remover.
Figure 6:
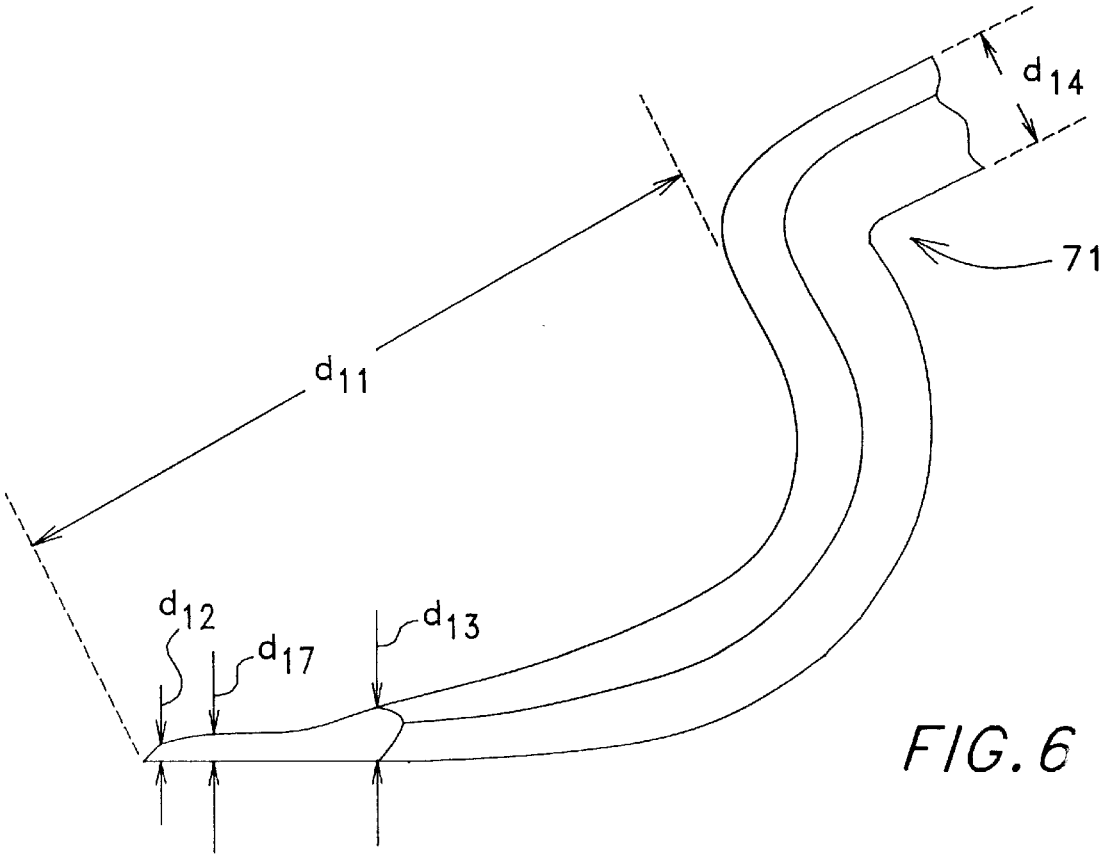
FIG. 6 is a side plan view of the preferred embodiment plastic clip and hinge pin remover.

Two other prior art tools suffer from the same malady. FIG. 4 shows a pop rivet removal tool 40 having a U shaped working end 41 which only has a single sloped surface 44 in the U shaped working end 41. FIG. 5 shows a pop rivet removal tool 42 which has a square shaped, flat working end 43. Both of these tools 40,42 tend to break pop rivet heads because all the prying force is applied to the head.

The preferred embodiment working end 72 of pop rivet and hinge pin removal tool 71 has a V shaped notch 73 with a pry ridge 70 running the length of the transition walls 74, 75 of the V shaped notch 73, and at the bottom thereof.

Nominal dimensions are =20°, $d_3$=1 19/64 inch, $d_4$=62/64 inch, $d_5$=30/64 inch, $d_6$=1 20/64 inch, $d_7$=4/64 inch, $_d8$=25/64 inch, $d_{80}$=18/64 inch, $d_9$=23/64 inch, $d_{10}$=40/64 inch, $d_{11}$=4 inch, $d_{12}$=3/64 inch, $d_{17}$=8/64 inch, $d_{13}$=18/64 inch, radius of curvaturer =5 inches, $d_{14}$=56/64 inch, $d_{15}$=20/64 inch, $d_{16}$=11 28/64 inch.

Referring next to FIGS. 6–10 the key facets of the present invention are shown. Pop river 100 has ribs 101 on its shank, a top 102 and the lip 103 of the top. In order to spread the prying force between both the lip(s) 103 and the rib 101, the angle and the relative dimensions shown must be used to enable the pry ridge 70 to fit under the thread 101 while at the same time have the lip(s) 103 extend over the upper surface 104 of the working end 72. Alternately the tool can be used as placed lower on the shank and use only the ribs 101 to remove the pop rivet.

Figure 8:
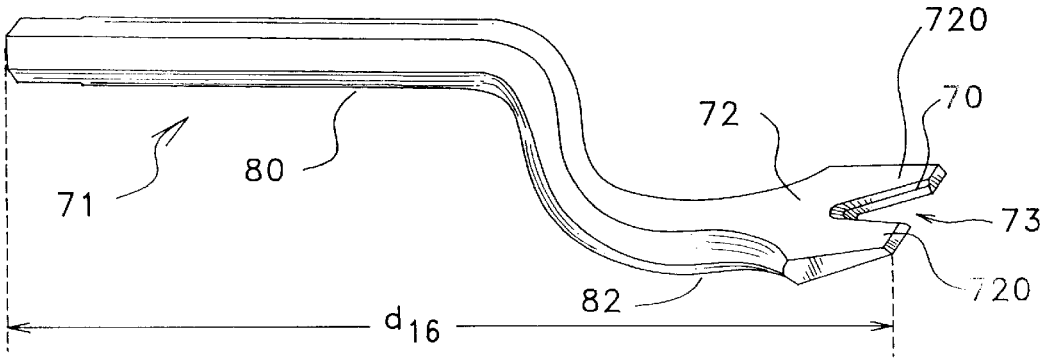
FIG. 8 is a top perspective view of the preferred embodiment.

FIG. 8 shows a simple pop rivet/hinge pin remover 71 having a handle 80, a transition shank 81 and a working end 72 parallel to and displaced from the handle 80. The pry ridge 70 is a non-obvious improvement over tool 1 of FIG. 1 because it prevents breaking the lip 103 of the 102 of pop rivet 100.

Figure 9:
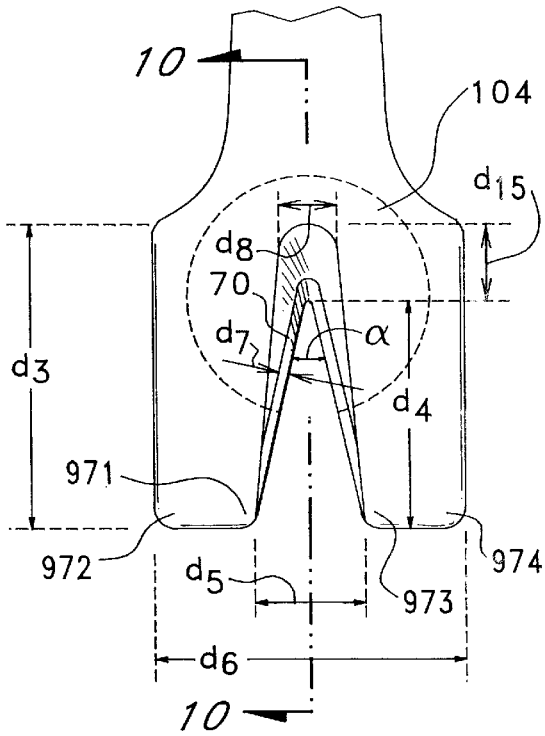
FIG. 9 is a top plan view of the preferred embodiment.
Figure 10:
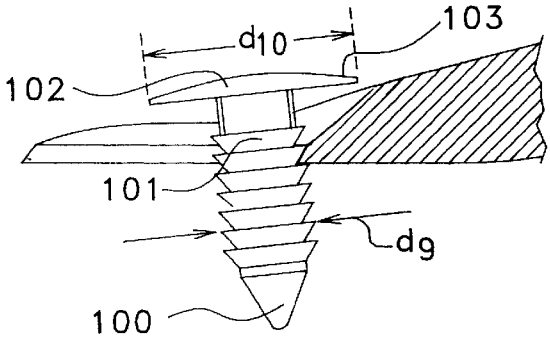
FIG. 10 is a partial sectional view of the preferred embodiment ready to pry out a plastic clip.

FIG. 9 shows all working edges 971,972,973,974 to be rounded. In operation the tool is wiggled back and forth to grasp the lip(s) 103, wherein the soft leather or vinyl or cloth interior might otherwise tear.

The dimensions shown allow for one size V notch to fit many pop rivet sizes, because various sized pop rivet shanks will slide up the V, yet still have the lip(s) 103 on top of the working surface 720 of the V notch.

One further use of the handle 80 can be to tap in a new pop rivet while using the working end 72 as a handle.

Figure 11:
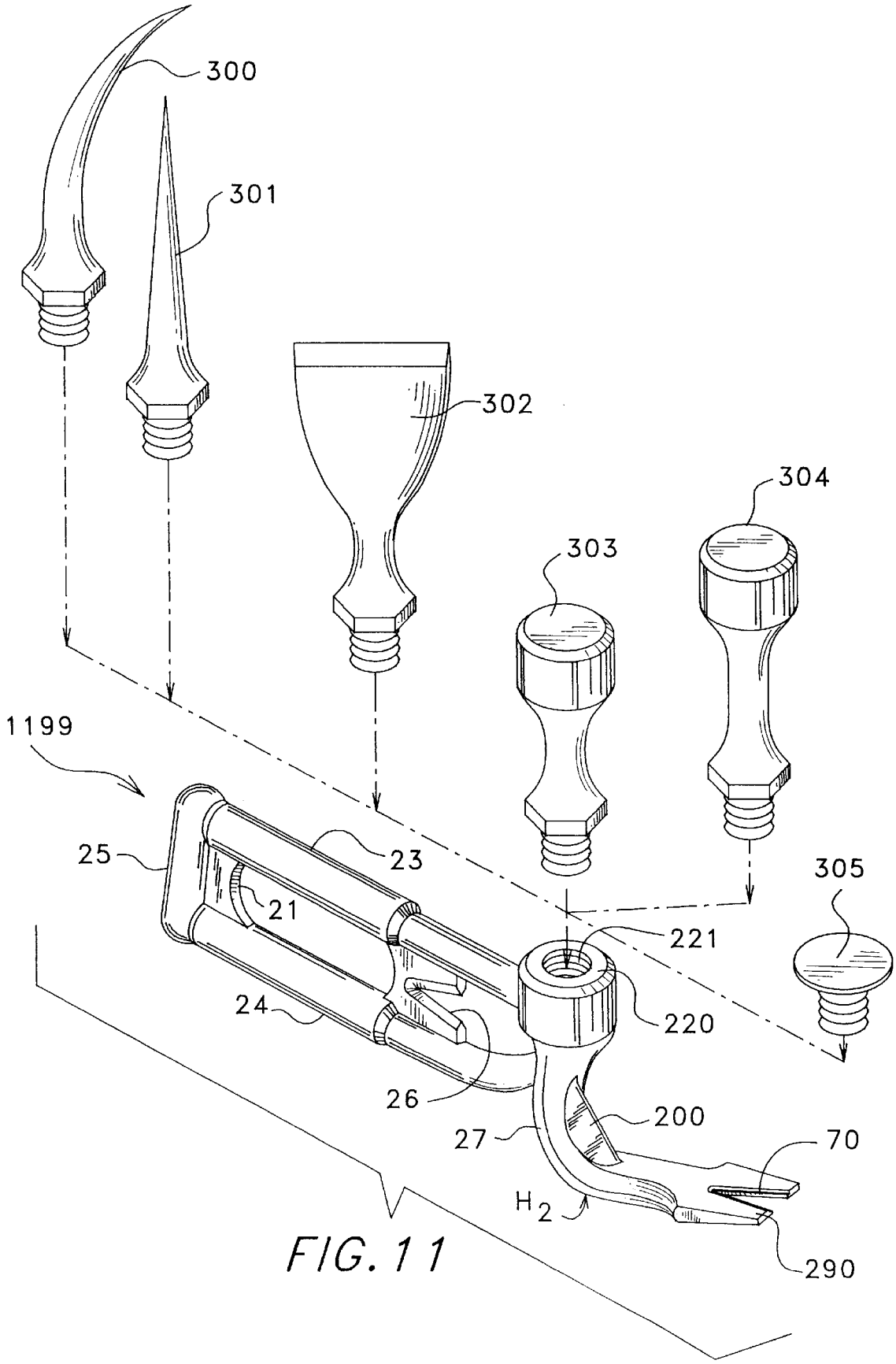
FIG. 11 is an exploded view of an alternate embodiment.

Referring next to FIG. 11 the prior art tool of FIG. 3 is improved 1199 by the addition of a pry ridge 70 in the V notch 290. The hammer surface 220 has a threaded hole 221 to receive a plurality of tools. Tool examples all have a male threaded base to engage hole 221. Cap 305 creates the original hammer 22 of FIG. 3. Extended head hammers 303,304 offer heavier hammers. A chisel/ax 302 can be used by hitting at $H_2$, or could be used as a small hatchet. A variety of picks 300,301 can be used to pick out dry rot or to counterpunch a hole.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A multi-purpose tool comprising:

a brace;

a first member extending perpendicular from said brace functioning as a handle;

a second rigid member extending perpendiculary from said brace and parallel to said first rigid member functioning as a hand guard;

a prying member disposed between said first and second rigid members;

a nail puller disposed between said first and second rigid members;

a blunt member formed from said first rigid members;

a curved member formed from said first and second rigid members;

a cutter having a cutting edge formed from said curved members;

a third rigid member formed from said curved member;

a V shaped working notch formed from said third rigid member; and pry ridge formed on the shaped working notch, thereby facilitating removal of a pop rivet.

2. The tool of claim 1, wherein said first rigid member further comprises a knurled handle.

3. The tool of claim 1, wherein said prying member further comprises a single ridge.

4. The tool of claim 1, wherein said nail puller further comprises a working notch.

5. The tool of claim 1, wherein said blunt member further comprises a hammer head.

6. The tool of claim 1, wherein said curved member further comprises a transition shaft.

7. The tool of claim 1, wherein said third rigid member further comprises a pry bar end disposed parallel to said first and second rigid members.

8. The tool of claim 1, wherein said hinge pin puller further comprises a working notch.

9. A multi-purpose tool comprising:

a handle having a transition shank;

a working notch extending form said shank;

a hammer head extending from said transition shank; and said hammer head having a face with a threaded hole to receive a plurality of working tools.

10. The apparatus of claim 9, wherein the plurality of working tools includes a hammer, a chisel and a pick.

11. A pry bar comprising:

a handle;

a transition shank extending from said handle formed to provide a fulcrum;

a working end extending form said transition shank;

said working end having a V shaped notch formed by a pair of lifting prongs;

said V shaped notch having a gap sized to encircle a shank of a pop rivet;

said pop rivet having ribs on said shank and a top;

said V shaped notch having a top with a lip wherein said V shaped notch lip simultaneously lies on a top lifting surface of the pair of lifting prongs when said notch encircles the shank;

said V shaped notch further comprising a working ridge sized to fit under a rib on the shank of said pop rivet; and wherein said V shaped notch lip is located above the working ridge a distance X, thereby functioning to lift both the rib on the shank and the top of the pop rivet simultaneously.

12. The apparatus of claim 11, wherein the working ridge has a location at a bottom of said V notch and running a length thereof.

13. The apparatus of claim 12, wherein the working ridge has a width of about 4/64 inch.

14. The apparatus of claim 12, wherein the pair of prongs each have a taper from a distal end having a minimal thickness to a bass of the V notch having a larger thickness.

15. The apparatus of claim 14, wherein said taper has a range of a radius of curvature of about 3 inches to about 5 inches.

16. The apparatus of claim 11, wherein the transition shank has a rearward-facing surface shaped to receive a hammer blow.

17. The apparatus of claim 11, wherein the V notch has a length ranging between one and two inches.

18. The apparatus of claim 11, wherein said base has a thickness of about a 20/64 inch.

19. A pry bar comprising:

a handle;

a transition shank extending from said handle formed to provide a fulcrum;

a working end extending form said transition shank;

said working end having a V shaped notch formed by a pair of lifting prongs;

said V shaped notch having a gap sized to encircle a shank of a pop rivet having ribs on said shank, a top with a lip, wherein said lip simultaneously lies on a top lifting surface of the pair of lifting prongs when said notch encircles the shank;

said V shaped notch further comprising a working ridge sized to fit under the rib on the shank of said pop rivet; and said transition shank has a rearward-facing surface to receive a hammer blow.

20. A multi-purpose tool comprising:

a brace;

a first rigid member extending perpendicularly from said brace functioning as a handle;

a second rigid member extending perpendicularly from said brace and parallel to said first rigid member functioning as a hand guard;

a nail puller disposed between said first and second rigid members;

a curved member formed from said first and second rigid members;

a third rigid member formed from said curved member;

a V shaped working notch formed from said third rigid member; and said brace having a rounded peripheral surface, thereby preventing a denting on a soft work surface when the rounded peripheral surface is used as a fulcrum, and the third rigid member is used as a handle to pry up a nail with nail puller.

21. The tool of claim 20, wherein the V shaped working notch further comprises a working ridge sized to fit under a rib on a shank of a pop rivet.

* * * * *